US010711335B2

(12) United States Patent
Lee et al.

(10) Patent No.: US 10,711,335 B2
(45) Date of Patent: Jul. 14, 2020

(54) BUBBLE PUMP RESISTANT TO ATTACK BY MOLTEN ALUMINUM

(71) Applicant: ARCELORMITTAL INVESTIGACIÓN Y DESARROLLO, S.L., Sestao Bizkaia (ES)

(72) Inventors: Yong M. Lee, Munster, IN (US); James M. Costino, Munster, IN (US); Igor Komarovskiy, Schererville, IN (US); Jerome S. Cap, Calumet City, IL (US); Ramadeva C. Shastry, Crown Point, IN (US)

(73) Assignee: ARCELORMITTAL INVESTIGACIÓN Y DESARROLLO, S.L., Sestao Bizkaia (ES)

( * ) Notice: Subject to any disclaimer, the term of this patent is extended or adjusted under 35 U.S.C. 154(b) by 0 days.

(21) Appl. No.: 14/391,618

(22) PCT Filed: Apr. 12, 2013

(86) PCT No.: PCT/US2013/036500

§ 371 (c)(1),
(2) Date: Oct. 9, 2014

(87) PCT Pub. No.: WO2013/155497

PCT Pub. Date: Oct. 17, 2013

(65) Prior Publication Data

US 2015/0104333 A1 Apr. 16, 2015

Related U.S. Application Data

(60) Provisional application No. 61/624,042, filed on Apr. 13, 2012.

(51) Int. Cl.
*F27D 27/00* (2010.01)
*C23C 2/00* (2006.01)
(Continued)

(52) U.S. Cl.
CPC ..... *C23C 2/003* (2013.01); *C23C 30/00* (2013.01); *F04F 1/18* (2013.01); *F27D 27/005* (2013.01); *F27D 2003/0054* (2013.01)

(58) Field of Classification Search
CPC ..... F04F 1/18; F27D 27/005
(Continued)

(56) References Cited

U.S. PATENT DOCUMENTS 3,606,291 A * 9/1971 Schneider ..... C21C 7/10 222/602
4,522,926 A 6/1985 Felice
(Continued)

FOREIGN PATENT DOCUMENTS

CN 101592186 A 12/2009
EP 0808914 A1 11/1997
(Continued)

OTHER PUBLICATIONS

Machine translation of SU 358851 A1, Dec. 20, 1972.

*Primary Examiner* — Scott R Kastler
(74) *Attorney, Agent, or Firm* — Davidson, Davidson & Kappel, LLC

(57) ABSTRACT

A bubble pump is provided. The bubble pump has an interior formed from a material that is resistant to attack by molten aluminum. The interior surface may be formed from a ceramic. The ceramic may be selected from the following: alumina, magnesia, silicate, silicon carbide, or graphite, and the mixtures thereof. The ceramic may be a carbon-free, 85% $Al_2O_3$ phosphate bonded castable refractory.

23 Claims, 2 Drawing Sheets

(51) Int. Cl.

| | |
|---|---|
| ***C23C 30/00*** | (2006.01) |
| ***F04F 1/18*** | (2006.01) |
| *F27D 3/00* | (2006.01) |

(58) Field of Classification Search
USPC ..... 266/235
See application file for complete search history.

(56) References Cited

U.S. PATENT DOCUMENTS

| | | | | |
|---|---|---|---|---|
| 5,203,910 | A | 4/1993 | Areaux et al. | |
| 5,650,120 | A | 7/1997 | Morando | |
| 5,735,935 | A | 4/1998 | Areaux | |
| 5,863,314 | A * | 1/1999 | Morando | B01F 3/04248 266/228 |
| 6,039,917 | A | 3/2000 | Morando | |
| 6,051,183 | A | 4/2000 | Morando | |
| 6,068,812 | A | 5/2000 | Areaux et al. | |
| 6,355,206 | B1 | 3/2002 | Hanzawa et al. | |
| 7,470,392 | B2 | 12/2008 | Cooper | |
| 2002/0148328 | A1 * | 10/2002 | Holz | C04B 41/5037 75/528 |
| 2007/0253807 | A1 | 11/2007 | Cooper | |
| 2011/0049878 | A1 * | 3/2011 | Goode | 285/405 |
| 2015/0104333 | A1 * | 4/2015 | Lee | C23C 2/003 417/108 |

FOREIGN PATENT DOCUMENTS

| | | | |
|---|---|---|---|
| JP | S5747860 | A | 3/1982 |
| JP | S59169971 | A | 9/1984 |
| JP | S6212653 | A | 1/1987 |
| JP | H0734209 | A | 2/1995 |
| JP | H09137265 | A | 5/1997 |
| JP | H10273763 | A | 10/1998 |
| JP | H10277726 | A | 10/1998 |
| JP | H11199334 | A | 7/1999 |
| JP | H11256298 | A | 9/1999 |
| JP | H11279729 | A | 10/1999 |
| JP | 2000119834 | A | 4/2000 |
| JP | 2000351672 | A | 12/2000 |
| JP | 2001158659 | A | 6/2001 |
| JP | 2001335906 | A | 12/2001 |
| JP | 2011168832 | A | 9/2011 |
| RU | 2247289 | C2 | 2/2005 |
| SU | 358851 | A1 | 12/1972 |
| SU | 1682409 | A1 | 10/1991 |

* cited by examiner

BUBBLE PUMP RESISTANT TO ATTACK BY MOLTEN ALUMINUM

FIELD OF THE INVENTION

The present invention relates to apparatus for the coating of molten metal onto steel. More specifically it relates to bubble pumps used in molten metal baths to remove surface dross from the molten metal in the vicinity of the steel strip being coated. Most specifically it relates to protection of the interior of such bubble pumps from attach attack and destruction by the molten metal.

BACKGROUND OF THE INVENTION

Molten aluminum and molten zinc have been used for years to coat the surface of steel. One of the coating process steps is to immerse the steel sheet in the molten aluminum or molten zinc. The surface quality of coating is very important to produce high quality coated products. However, introduction of aluminized steel for the US market in 2007 was quite a challenge for the aluminizing lines. Early trials resulted in >50% rejects due to coating defects.

One of the major sources of defects was dross floating on the aluminum bath within the snout and sticking to the strip. To achieve high quality surface finish, floating dross and oxides in the molten metal bath, especially in the confined regions inside the snout, need to be diverted from the surface being coated. Carbon steel pneumatic dross pump, also referred to as bubble pump, has been used to remove the dross from the coating zone. Implementing push and pull snout pumps to ensure a dross-free melt surface inside the snout made high quality coating possible. The bubble pump (a.k.a. dross pump) uses the artificial lift technique of raising a fluid such as water or oil (or in this case molten metal) by introducing bubbles of compressed gases, air, water vapor or other vaporous bubbles into the outlet tube. This has the effect of reducing the hydrostatic pressure in the outlet tube vs. the hydrostatic pressure at the inlet side of the tube. The bubble pump is used in the molten metal bath of the metal coating lines to remove floating dross from surface of the aluminizing bath inside the snout in order to prevent dross-related defects on the coated strip. Thus, the bubble pump is a critical hardware component in the production of high quality automotive aluminized sheet.

One of the major factors impacting production costs is aluminizing pot hardware failures. Prominent among hardware failures is the failure of the bubble pump (pull pump). The average service life of bubble pumps made of carbon steel is 8-12 hours, resulting in the use of 35-40 pumps every month (for a 2 week production). The change of carbon steel bubble pumps during production leads to production disruption and contamination of molten metal bath. In addition, the "quality" of the coated steel sheet must be downgraded (resulting in a less valuable product) during carbon steel pump changes. Further, pump changes require line stops and restarts, leading to excessive consumption of startup coils. Average losses attributable to bubble pumps are about close to a million U.S. dollars per year. An increase in life of the bubble pump will significantly reduce the quantity of downgraded sheet, and will reduce downtime and costs.

Thus, there is a need in the art for bubble pumps for use in molten aluminum baths that can last significantly longer than bare carbon steel tube pumps.

SUMMARY OF THE INVENTION

The present invention provides a bubble pump having an interior formed from a material that is resistant attack by molten aluminum. The interior surface may be formed from a ceramic. The ceramic may be selected from the group consisting of alumina, magnesia, silicate, silicon carbide, or graphite, and the mixtures. The ceramic may be a carbon-free, 85% Al2O3 phosphate bonded castable refractory.

The exterior of the bubble pump may be formed from carbon steel tubing. The bubble pump may be formed from multiple sections of tubing bound together. The bubble pump may include 3 straight pieces of tubing and 3 elbow pieces of tubing. The multiple sections of tubing may be bound together by compression flange joints. The compression flange joints may compress the interior ceramic material such that molten aluminum cannot penetrate the joint. The compression flange joints of the interior material that is resistant attack by molten aluminum may form a 45 degree angle male/female joint between sections of bubble pump.

BRIEF DESCRIPTION OF THE DRAWINGS

A preferred embodiment of the present invention will be elucidated with reference to the drawings, in which.

DETAILED DESCRIPTION OF THE INVENTION

The present inventors sought to develop a way to improve the pump performance and significantly increase service life of the pumps, preferable to at least five days. Extensive investigations of the failure modes of the carbon steel bubble pumps were conducted. Based on the results, the present inventors have developed an improved bubble pump with a cast ceramic protective lining. One embodiment of the improved pump has lasted continuously up to 167 hours (~7 days) without failure, demonstrating a major performance advantage over the 8-12 hours of service life normally experienced with the carbon steel pumps in molten aluminum. Changes in pump design and the incorporation of a cast refractory lining are the key factors in the improvement.

Figure 1:
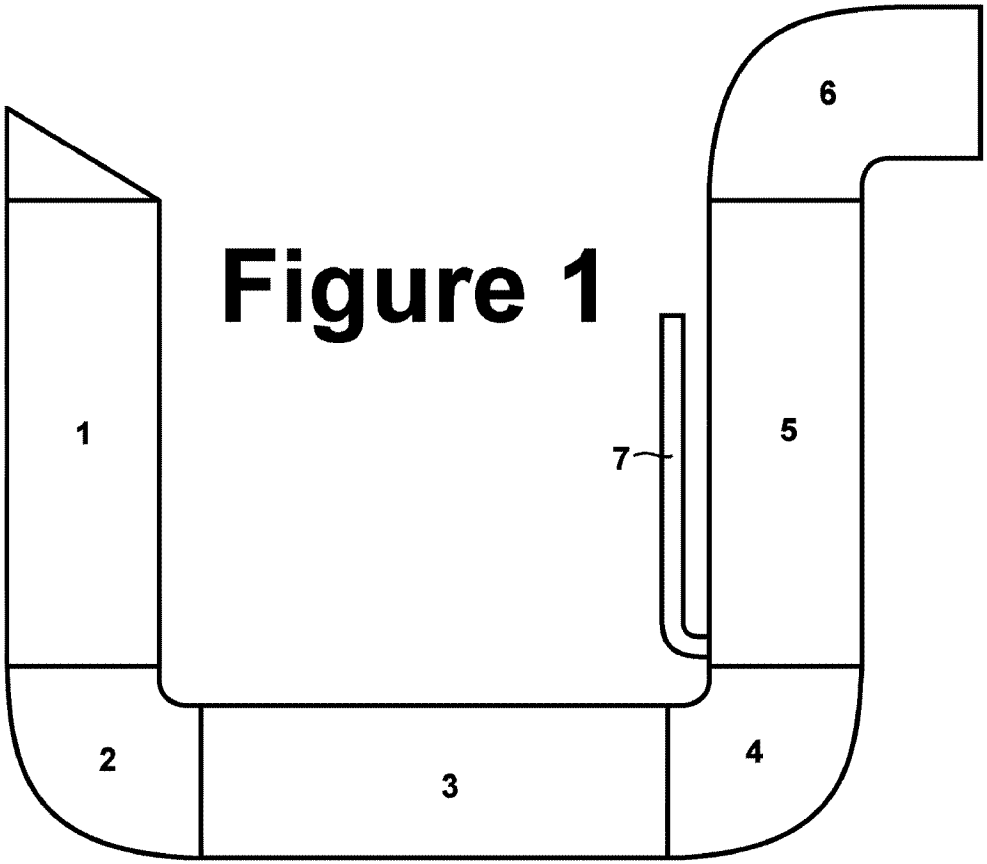
FIG. 1 is a schematic diagram, not to scale, of a bubble pump.

FIG. 1 is a schematic diagram, not to scale, of a bubble pump. The bubble pump includes: a vertical inlet portion 1, an elbow 2 which connects the vertical inlet 1 to a horizontal piece 3, another elbow 4 connects the horizontal piece 3 to a vertical outlet piece 5, and an outlet elbow 6 to direct the outflowing metal, which contains unwanted dross, away from the coating zone of the metal bath. Attached to the vertical outlet piece 5 is a gas input line 7. The line 7 is used to inject gas into the molten metal cause a lower pressure on the vertical outlet leg, resulting in metal flowing down into the vertical inlet 1 and up/out of the vertical outlet 5.

Analysis of Failure Mode

The U-shaped bubble pump operates in the melting pot at a temperature of 668° C. (1235° F.). The chemistry of the melt is typically Al-9.5% Si-2.4% Fe. The inlet of the pump is positioned within the molten aluminum bath, inside the snout and the outlet is positioned on the outside of the snout. Pumping action is created by bubbling nitrogen in the vertical leg of the pump on the outlet side. Nitrogen at ambient temperature is introduced at 40 psi and at flow rates of ~120 standard cubic feet per hour (scfh, 90-150 scfh). Expansion of the nitrogen creates bubbles that escape through the outlet expelling simultaneously liquid metal. The expulsion creates a pressure difference between the two sides of the pump, generating suction that allows the melt and floating dross to be sucked in at the inlet. The process is continuous, thereby enabling continuous removal of dross from the inside of the snout and expulsion to the outside.

There are three main areas of failure in the bubble pumps, in order of severity: 1) within the discharge head (elbow 6); 2) around the nitrogen inlet nipple in vertical section on the outlet side (vertical piece 5); and 3) in the middle of vertical section on the inlet side (vertical piece 1). In order to better understand the mode of failure, a regular carbon steel pump that failed after about 12 hours of service was split in half and analyzed. Analysis shows that the horizontal bottom part of the pump is almost intact, while the inlet and outlet sections are severely damaged. Also, the material loss occurs mostly on inside of the bubble pump, while the outside diameter remains unchanged. The degree of attack is different in different locations of the pump.

Water Modeling of the Bubble Pump

The inventors believed that fluid dynamics inside the pump affected the failure mode. However, design factors which influenced the fluid flow were not well understood. In order to investigate the influence of melt turbulence, a small Plexiglas bubble pump model (1:2 scale) was built and operated in water. The model allowed the investigation of the effect of gas pressure, inlet position, the elbow radius, orientation and shape of the outlet on pump operation and performance. The water flow characteristics in the pump during normal operation were ascertained and it was determined that the locations of corrosion and metal loss observed in the failed pumps correspond to the locations of turbulence inside the water model.

Mechanism of Aluminum Attack

The mechanism of material loss in the carbon steel pump was investigated by metallographic techniques. There are several stages of aluminum attack. In the first moments of aluminum contact with the pump, a hard and brittle intermetallic layer forms on the inside wall as a result of the reaction between the liquid aluminum and steel surface. This layer substantially restricts the diffusion of aluminum and iron through it and limits further attack on steel. The intermetallic layer thus serves as a quasi-protective coating on the metal body. However, whenever mechanical stresses appear on the surface, this brittle layer develops microcracks and spalls off the steel surface, creating deep pits. Because the bottom of the pit is no longer protected by the intermetallic layer, it is attacked by the melt until a new layer is formed. This process repeats itself while the stresses continue to be present on the steel surface and the loss of metal will continue to increase as a result. The stresses involved in the attack are likely to be the result of melt turbulence and/or impingement of foreign particles at susceptible locations. The process of attack can therefore be characterized as dynamic erosion by the liquid aluminum.

Thus, the failure of carbon steel bubble pumps in service is by dynamic pitting and abrasive wear (dynamic erosion). The degree of attack is different at different locations. The outer surface of pump, being not exposed to melt turbulence, suffers less damage and therefore survives in the melt with minimal protection. The melt attack and metal loss progresses mostly from the inside outward.

The present inventors have determined that coatings which can withstand molten aluminum attack in stagnant melts are likely to fail under turbulence conditions experienced in the pump. Strong coating adhesion to pump body is crucial for protection under such dynamic conditions. The inventors have further determined that in order to improve the pump performance it is necessary to isolate the inside surface of the pump from molten aluminum. The isolating layer must be adherent, thick and continuous. Any opening in the protective layer could lead to the pump failure.

Selection of Refractory Material for Protective Lining

Based on the knowledge from failure investigation and water modeling the present inventors developed a new bubble pump. The requirements for protective lining materials were: 1) non-wetting materials against liquid aluminum penetration; 2) thermal shock resistant materials to avoid preheating; 3) erosion resistant materials; 4) low cost; and 5) design flexibility. In order to meet the requirements, a literature search and laboratory testing were performed. A carbon-free, 85% Al2O3 phosphate bonded castable refractory was selected.

Design of Inventive Pump

The shape of the standard carbon steel bubble pump contains three 90 degree elbow sections. The complicated shape makes it very difficult to cast the ceramic lining inside the entire shell without joints. It was therefore necessary to cut the shell into several sections, cast each section separately and assemble the pump subsequently. It is also necessary for the joint of each assembled part to maintain integrity during use. To address these stringent requirements, the following ideas features were applied in assembling the pump: 1) unique 45 degree angle male/female joints between sections of refractory lining; 2) two flange joints to assemble the three pieces of the pump, allowing the joints of the ceramic protective lining to be placed under compression; 3) continuous ceramic lining in elbows to reduce aluminum attack through joints; and 4) flange modification in the outlet area to put the ceramic lining under compression.

Figure 2:
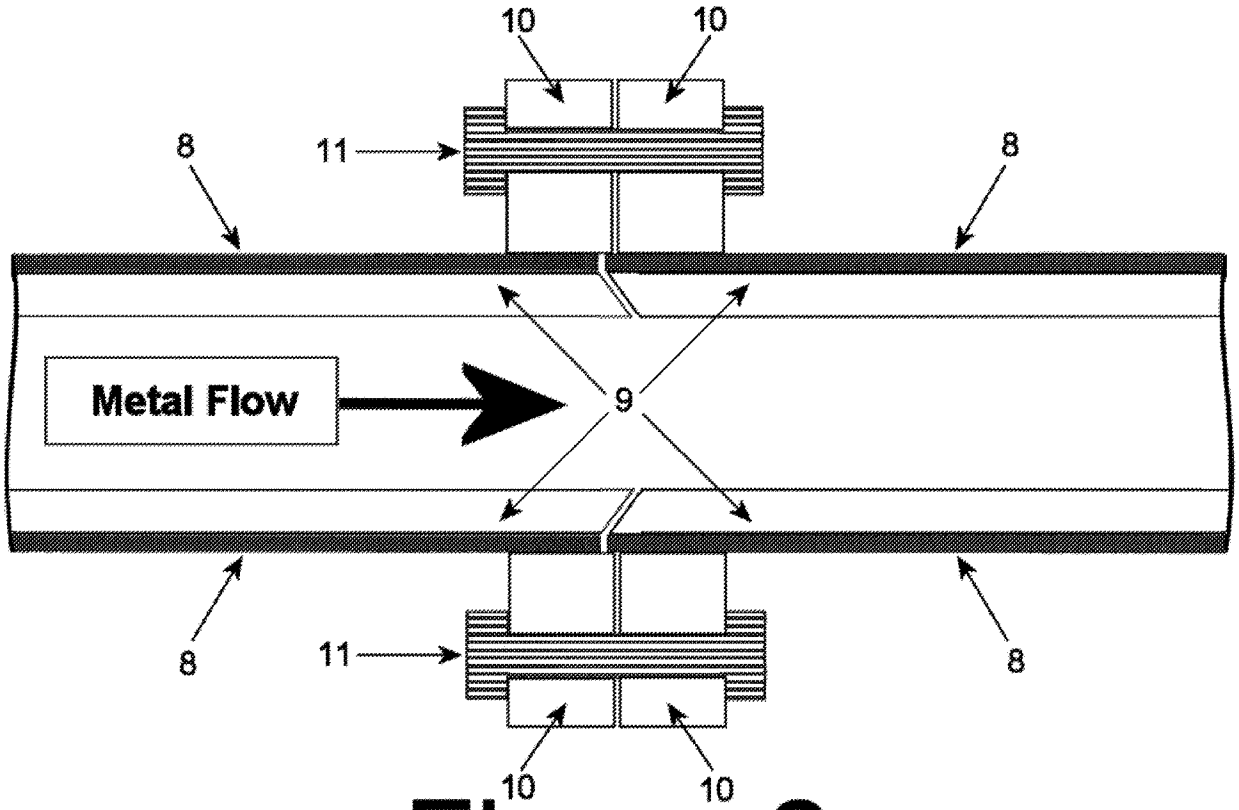
FIG. 2 is a schematic depiction of a cross section of the joint between pieces of the bubble pump.

FIG. 2 is a schematic depiction of a cross section of the joint between pieces of the bubble pump. The joint includes the carbon steel shell 8 of the prior art bubble pumps, each piece of which is lined with the motel metal resistant ceramic 9. The ends of the ceramic 9 which are to abut one another are angled at about a 45 degree angle, for example, to allow for a good compression fitting. The parts of the bubble pump are joined together under compression by the flange joints 10, using fastening means 11.

The compression joints are used to maintain the protective lining joint under compression to seal off the protective lining joint against molten metal penetration. The protective lining may be formed from any material that is resistant to attack by molten aluminum, such as non-wetting materials against molten metals. Examples of the non-wetting materials include alumina, magnesia, silicate, silicon carbide, or graphite, and the mixtures of these ceramic materials.

What is claimed is:

1. A bubble pump comprising:

a plurality of hollow parts, each part having a protective lining; and at least one compression flange joint connecting at least two of the plurality of hollow parts and maintaining the protective lining under compression.

2. The bubble pump of claim 1, wherein the protective lining includes an interior surface that is formed from a ceramic.

3. The bubble pump of claim 2, wherein the ceramic is selected from the group consisting of alumina, magnesia, silicate, silicon carbide, or graphite, and mixtures thereof.

4. The bubble pump of claim 2, wherein the ceramic is a carbon-free, 85% $A1_{23}$ phosphate bonded castable refractory.

5. The bubble pump of claim 1, wherein an exterior of the plurality of hollow parts is formed from carbon steel tubing.

6. The bubble pump of claim 1, wherein the plurality of parts includes three straight pieces and three elbow pieces.

7. The bubble pump of claim 1, wherein the flange compression joints compress the protective lining so molten aluminum cannot penetrate the joint.

8. The bubble pump of claim 1, wherein the plurality of hollow parts include at least one angled face on an end of the part.

9. The bubble pump of claim 8, wherein the at least one angled face of one of the plurality of hollow parts is a complement with another angled face of another of the plurality of hollow parts.

10. The bubble pump of claim 9, wherein the compression flange joints connect the at least two hollow parts in proximity of the angled faces.

11. The bubble pump of claim 1, wherein the plurality of hollow parts are connected to one another in a U-shape.

12. The bubble pump of claim 11, wherein the bubble pump has an outlet at a top of the U-shape and an inlet at another top of the U-shape.

13. The bubble pump of claim 1, further comprising a gas input line for injecting gas into the plurality of hollow parts.

14. A bubble pump comprising:

an interior formed from a non-wetting ceramic material that is resistant to attack by molten aluminum, the interior having at least one compression joint; and an exterior formed from carbon steel tubing.

15. The bubble pump of claim 14, wherein the ceramic is selected from the group consisting of alumina, magnesia, silicate, silicon carbide, or graphite, and mixtures thereof.

16. The bubble pump of claim 14, wherein the ceramic is a carbon-free, 85% $A1_{23}$ phosphate bonded castable refractory.

17. The bubble pump of claim 14, wherein said pump is formed from a plurality of sections of tubing bound together.

18. The bubble pump of claim 17, wherein the plurality of sections of tubing include 3 straight pieces and 3 elbow pieces.

19. The bubble pump of claim 17, wherein the plurality of sections of tubing are bound together by at least one compression flange joint.

20. The bubble pump of claim 19, wherein the flange compression joints compress the interior ceramic material such that molten aluminum cannot penetrate the joint.

21. The bubble pump of claim 20, wherein at least one flange compression joint has at least one angled face.

22. The bubble pump of claim 10, wherein the at least one angled face is in the shape of a bevel.

23. The bubble pump of claim 22, wherein the bevel has a 45-degree angle.

* * * * *